United States Patent [19]

Vaughn

[11] Patent Number: 4,906,001

[45] Date of Patent: Mar. 6, 1990

[54] FOOTBALL CENTERING DEVICE

[76] Inventor: Donald E. Vaughn, 9320 52nd St. N., Pinellas Park, Fla. 34666

[21] Appl. No.: 351,680

[22] Filed: May 12, 1989

[51] Int. Cl.[4] ..... A63B 67/00

[52] U.S. Cl. ..... 273/55 R; 124/7; 124/36

[58] Field of Search ..... 273/55 R, 359, 94; 124/36, 7; 272/93

[56] References Cited

U.S. PATENT DOCUMENTS

| | | | |
|---|---|---|---|
| 894,738 | 7/1908 | Hindmarsh | 124/7 |
| 1,862,877 | 6/1932 | Andersen | 124/7 |
| 2,767,985 | 10/1956 | Maxcey, Jr. et al. | 273/55 R |
| 2,940,757 | 6/1960 | Britt | 273/55 R |
| 3,044,776 | 7/1962 | Weidmaier et al. | 273/55 R |
| 3,399,892 | 9/1968 | Jurkieweicz | 273/55 R |
| 3,467,380 | 9/1969 | Bonacci | 273/55 R |
| 3,605,715 | 9/1971 | Welbourn | 124/36 |
| 3,700,238 | 10/1972 | Mathis | 273/55 R |
| 3,794,325 | 2/1974 | Stender | 124/7 |

*Primary Examiner*—T. Brown

*Attorney, Agent, or Firm*—Ronald E. Smith; Joseph C. Mason

[57] ABSTRACT

A football centering device. A cradle for a football is mounted at the end of a spring-loaded, pivotally mounted arm member that pivots in a vertical plane and which is mounted on an upstanding post. A latch holds the cradle in a cocked position near ground level until the player releases the latch with his foot. When the latch is released, the spring unloads and the arm swings upwardly in a vertical plane. The cradle at the end of the arm delivers the ball to the player in a manner that closely simulates the delivery of a human center.

19 Claims, 3 Drawing Sheets

48
46
40
47
50
51
36
35
34
10
22
30
24
20
60
57
63
16
12
58
66

14
40
43
44
42
12
18
50
47
48
46
36a
26
35
22
26
20
30
16
31
63
51
66
16
36b
32
28
37
34
33
24
28

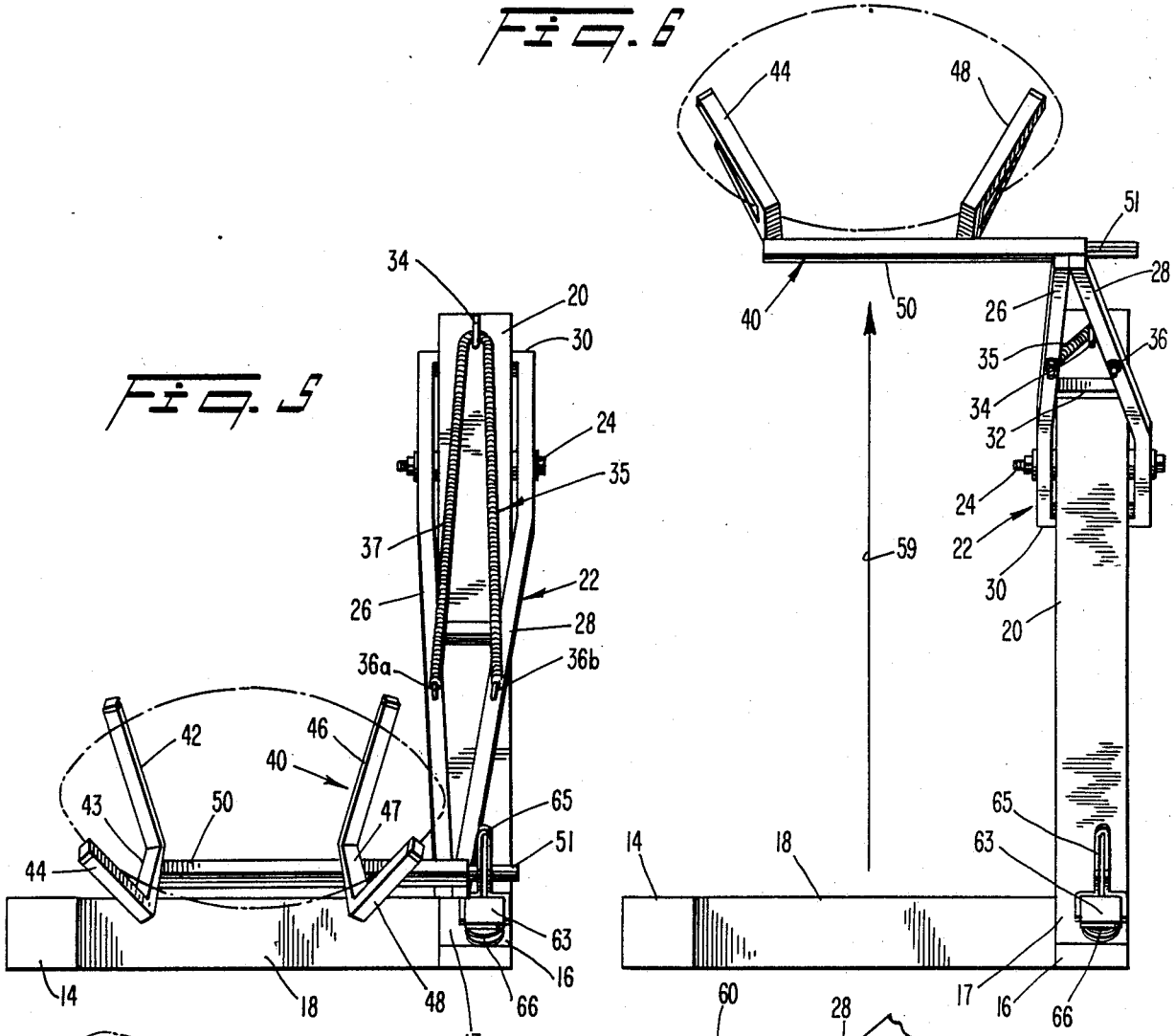
Fig. 6
Fig. 5
44
48
51
28
26
36
35
34
32
24
22
30
20
59
40
50
14
18
65
63
16
17
66
34
20
30
24
35
37
22
26
28
36a
36b
42
46
40
43
50
47
44
48
60
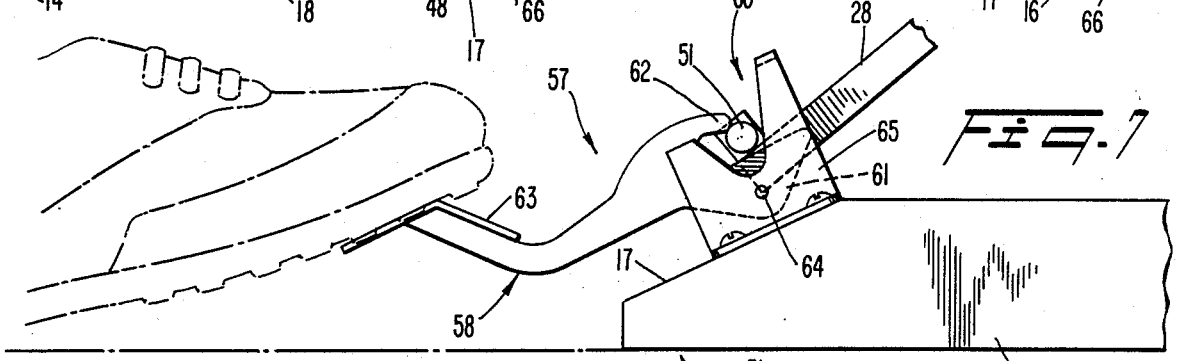
Fig. 7
57
62
51
28
65
61
63
64
17
58
16
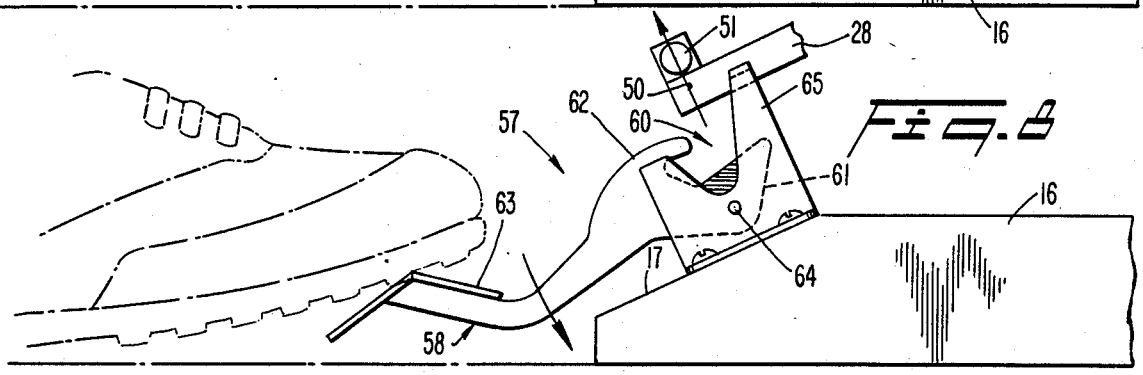
Fig. 8
51
28
50
65
57
62
60
61
63
16
17
64
58

FOOTBALL CENTERING DEVICE

TECHNICAL FIELD

This invention relates, generally, to athletic training equipment. More particularly, it relates to a football centering device that delivers a football to the hands of a quarterback in a manner that very closely simulates the delivery of a human center.

BACKGROUND ART

A football offensive line coach will often desire to drill the offensive line at the same time the quarterback coach desires to drill the quarterback. As a result, the linemen often must practice plays without the presence of the center. Similarly, the quarterback must often wait for the linemen to finish their drills before he can commence with his practice.

For these and other reasons, inventors have developed a number of mechanical devices intended to deliver a football to a quarterback.

For example, a hiking mechanism is shown in the following U.S. Pat. Nos.: 3,044,776 to Weidmaier et al.; 3,467,380 to Bonacci; 2,767,985 to Maxuey, Jr. et al.; 3,399,892 to Jurkiewicz; and 3,700,238 to Mathis. Other patents which show football training equipment but which do not show football centering devices are U.S. Pat. Nos. 2,940,757 to Britt and 2,521,649 to Paupa.

Some of the prior art devices are extraordinarily complex in structure and are thus expensive to manufacture.

Although the art is somewhat developed, a need remains for a device that is mechanically simple, and thus economical to manufacture. Moreover, there remains a need for a device that delivers a football to a quarterback in a manner that closely simulates the delivery by a human center.

DISCLOSURE OF INVENTION

The present invention delivers a football to a quarterback in a manner that closely simulates the centering action of a human center. The player positions his hands in the same position he would with a human center present, and steps on a foot pedal; the ball is thrust into his hands by the device with substantially the same speed and force as it would be by a human center.

The machine includes a pivotally mounted arm that has a cradle for supporting a football at its distal free end. The arm is pivotally attached to an upstanding post member and is supported in an inclined plane, when at equilibrium, by a spring member. The spring member is loaded when the cradle-carrying end of the arm is pivoted downwardly; at its lowermost position, the arm enters a latch that engages it until the latch is released by applying pressure to the foot pedal. When the latch is released, the spring unloads and sharply returns the pivotally mounted arm, and its football-supporting cradle, to an equilibrium position. The cradle is specifically configured so that it does not hit the player's hands when the spring unloads.

The primary object of this invention is to provide a football centering device that delivers a football to a quarterback with substantially the same feel as a human center.

The invention accordingly comprises the features of construction, combination of elements and arrangements of parts that will be exemplified in the construction set forth hereinafter and the scope of the invention will be set forth in the claims.

BRIEF DESCRIPTION OF DRAWINGS

For a fuller understanding of the nature and objects of the invention, reference should be made to the following detailed description, taken in connection with the accompanying drawings, in which:

FIG. 5 is a front elevational view of the apparatus in its loaded or cocked configuration;

FIG. 6 is a front elevational view of the apparatus in its equilibrium position;

FIG. 7 is a side elevational view of the latch means of this invention in its equilibrium position, but with the biased elongate arm member of this invention in its cocked configuration; and FIG. 8 is a side elevational view of the latch means showing the release of the cocked arm member.

Similar reference numerals refer to similar parts throughout the several views of the drawings.

BEST MODES FOR CARRYING OUT THE INVENTION

Figure 1:
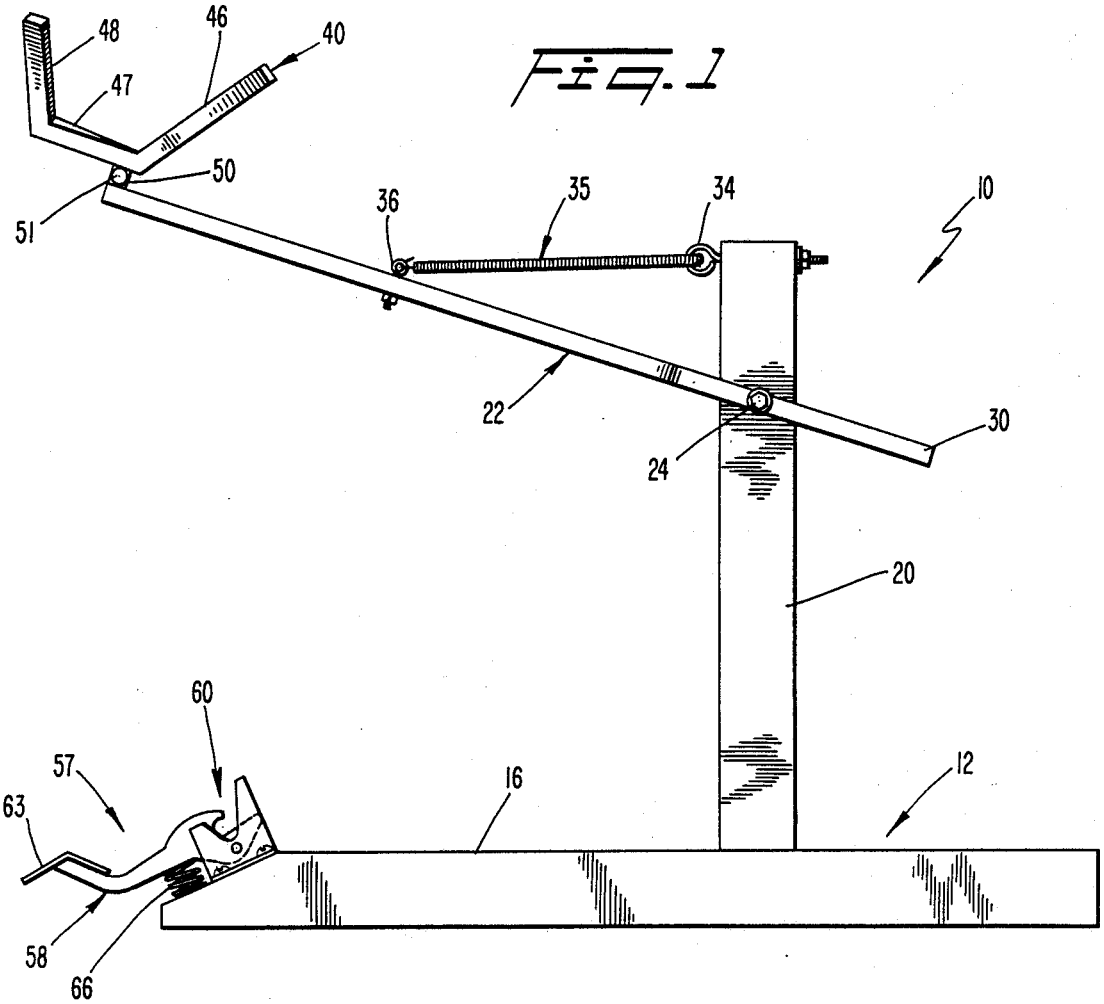
FIG. 1 is a side elevational view of the novel apparatus in its equilibrium position.
Figure 2:
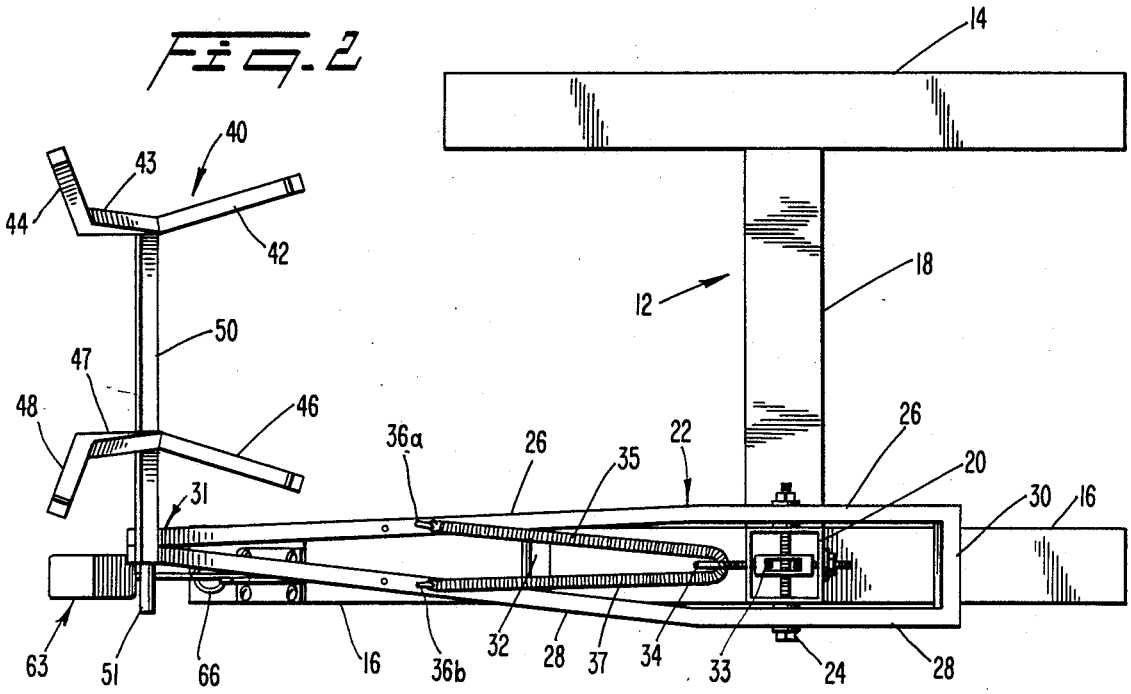
FIG. 2 is a top plan view of the apparatus in its equilibrium position.

Referring now to FIGS. 1–4, it will there be seen that an illustrative embodiment of the invention is denoted by the reference numeral 10 as a whole.

Apparatus 10 has an "H"-shaped base means 12 that includes a first longitudinally disposed base member 14, a second longitudinally disposed base member 16 having a longitudinal extent greater than that of member 14, and a transversely disposed crossbar 18. The illustrated "H" configuration is presently preferred for its ease of construction and the good stability it provides, but it should be understood that base means 12 could be provided in virtually any preselected geometrical configuration.

An upstanding hollow post member 20 is fixedly secured to elongate base member 16 at a position along its extent where it intersects with crossbar 18.

Arm member 22 is pivotally mounted to post 20 as at 24. Arm member 22 includes elongate parts 26, 28 that are joined behind post 20 by transversely disposed crossbar 30. The parts gradually converge forwardly of post 20 as depicted and meet in front of post 20 as at 31. A second crossbar 32 that is positioned in front of the post provides a strengthening means.

An eyebolt 34 extends through post 20 at the top thereof and provides a mount for elongate spring member 36; it is discontinuous at turnbuckle 33. The opposite ends **36*a*, 36*b* of spring 36 are fixedly secured by suitable means to parts 26, 28 about midway between pivot point 24 and the point 31 where parts 26, 28 converge. The middle of spring 36 extends through the eye of eyebolt 34. Accordingly, parts 35, 37 of spring 36** are of the same length.

Football cradling means 40 includes a first pair of generally upwardly extending retainer members 42, 44, which are interconnected at their respective lowermost ends by a first generally longitudinally disposed frame base member 43 and further includes a second pair of generally upwardly extending retainer members 46, 48, which are interconnected at their respective lowermost ends by a second generally longitudinally disposed frame base member 47. A transversely disposed cradle base member 50 interconnects frame base members 43 and 47.

Figure 3:
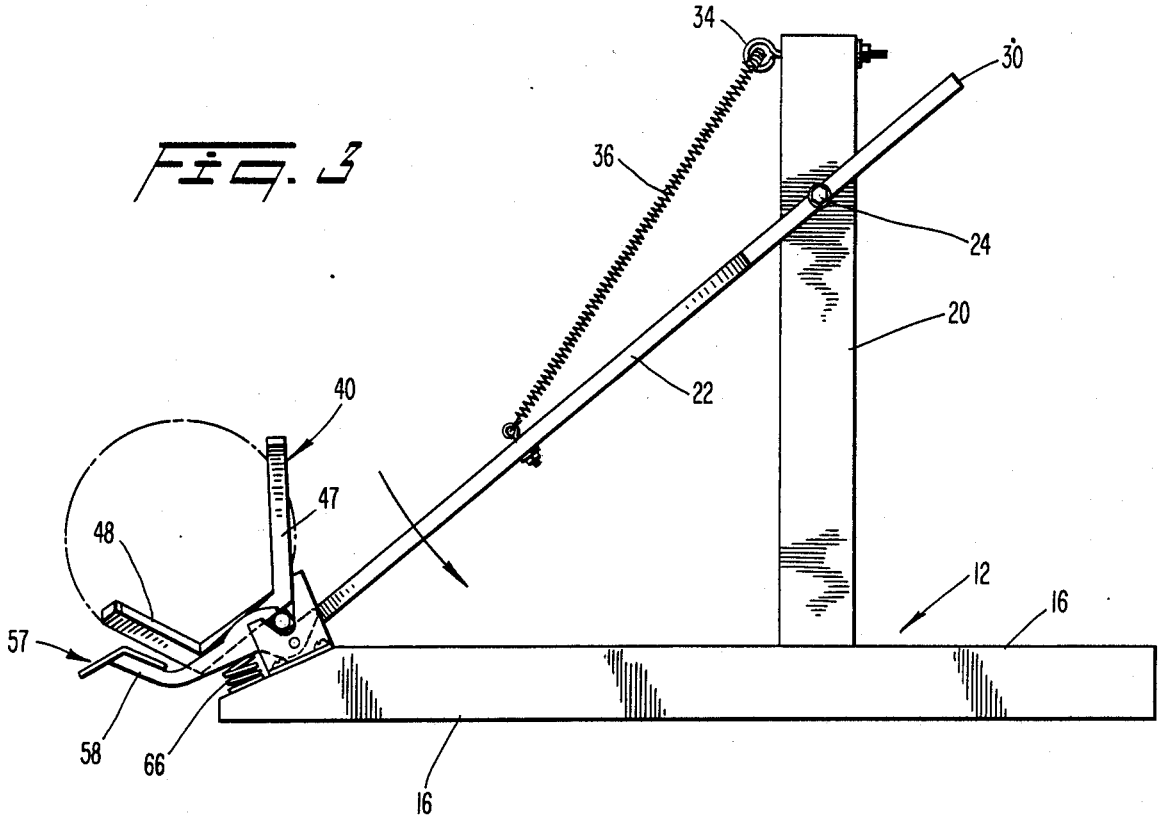
FIG. 3 is a side elevational view of the apparatus in its loaded or cocked configuration.
Figure 4:
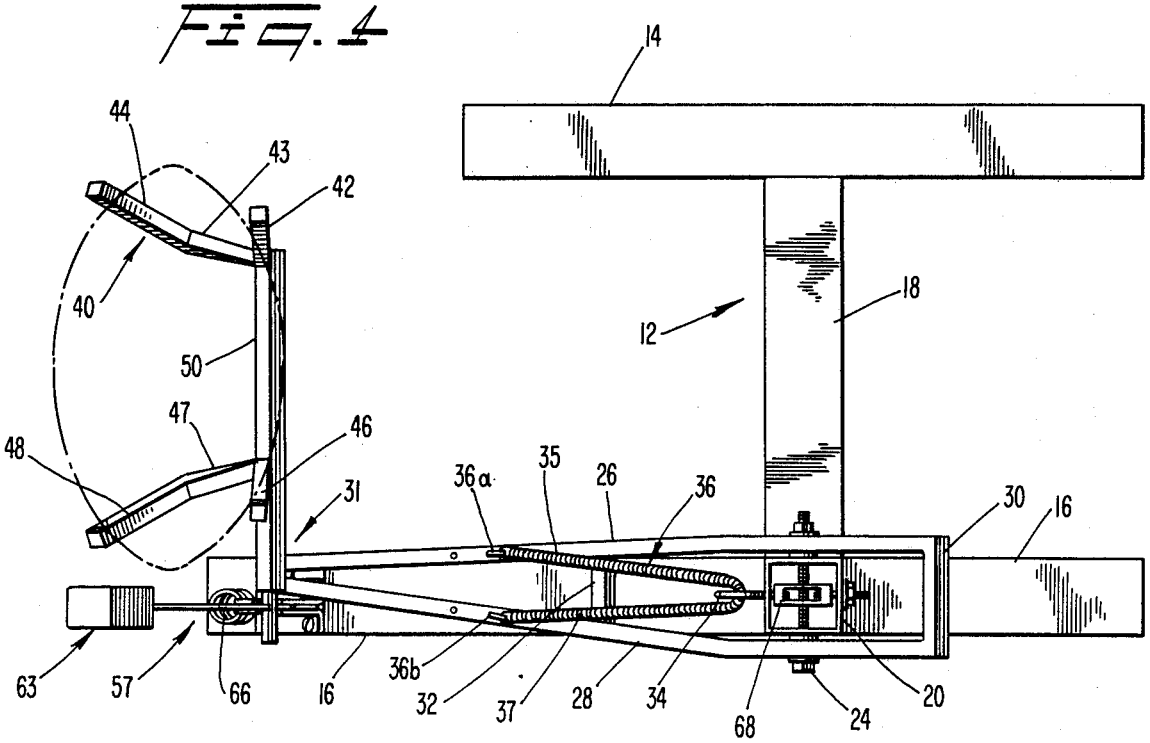
FIG. 4 is a top plan view of the apparatus in its loaded or cocked configuration.

The latch means that retains the football cradling means in its cocked position as depicted in FIGS. 3 and 4 is generally denoted 57 and is best shown in FIGS. 7 and 8. A bell crank 58 having arms 61, 62 is pivotally mounted at its fulcrum 64 to latch frame member 65. Frame 65 is secured to a downwardly sloped forward surface 17 of base member 16, and an upwardly opening cavity 60 is formed therein. Bias means 66 maintains the bell crank 58 in its equilibrium position until downward pressure is applied to foot pedal 63.

Transverse cradle base member 50 has an extension 51 (see lower left corner of FIG. 2) that enters cavity 60 when arm 22 is cocked by being pivoted in a counterclockwise direction about pivot point 24. As extension 51 is urged into cavity 60, it transiently displaces arm 62 of bell crank 58 and drives it out of cavity 60, thereby compressing bias means 66. When extension 51 fully enters cavity 60, it disengages from arm member 62 and spring 66 drives arm member 62 back into the cavity 60, where it overlies extension 51 and captures it. FIGS. 3, 4, 5 and 7 depict the frame in its captured configuration.

Rotation of arm 22 so that extension member 51 is captured in cavity 60 by arm member 62 loads spring 66; accordingly, when the quarterback steps on foot pedal 63, as depicted in FIG. 8, the bias of spring 66 is overcome, arm member 62 pivots about fulcrum 64 and withdraws from cavity 60, thereby releasing extension member 51. As spring 66 unloads, arm 22 pivots about pivot point 24 and briskly delivers a cradled ball to the waiting hands of the player, as indicated by the upwardly directed arrow 59 in FIG. 6. The outwardly flared configuration of the retainer members 42, 44, 46, 48 insures that they will not impact against the player's fingers.

The length of spring 66 is preselected so that when the spring is at equilibrium, arm 22 is held in an inclined plane as depicted in FIG. 1.

Spring members of differing lengths may be used to change the equilibrium position of device 10 so that the apparatus can be used by players of widely differing heights. Preferably, however, eyebolt 34 is axially displaced forwardly to lower the at rest position of the cradle means and is axially displaced in the opposite direction to raise its at rest position; turnbuckle 33 provides the desired adjustability.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus that centers a football to a quarterback, comprising:

an apparatus support base means;

an upstanding post member supported by said base means;

an elongate arm member pivotally mounted to said post member for pivoting in a substantially vertical plane;

a first bias means extending between said post member and said arm member for said arm in an upward direction;

a football cradling means connected to one end of said arm member said cradle means being comprised of a pair of ball retainer member connected together by connector means each retainer member having a U-shaped configuration and being latterally spaced with respect to each other and are aligned in generally parallel alignment with said elongated arm member;

a latch means adapted to releasably engage said football cradling means;

said latch means being mounted on said base means;

said first bias means being under tension when said cradling means is engaged by said latch means; and foot-operated means for releasing said latch means;

whereby said arm member pivots with respect to said post member and said cradling means follows an upward, arcuate path of travel to deliver a football cradled thereby into the hands of a quarterback when said latch means is released.

2. The apparatus of claim 1, wherein said cradling means cradles a football such that the longitudinal axis of the football is disposed transversely to the longitudinal axis of the elongate arm member.

3. The apparatus of claim 2, wherein said base means includes a pair of parallel, longitudinally disposed base members interconnected to one another by a transversely disposed cross bar member.

4. The apparatus of claim 3, wherein said latch means is mounted on a preselected longitudinally disposed base member at a first end thereof.

5. The apparatus of claim 4, wherein the first end of said preselected base member has a downwardly inclined surface formed therein and wherein said latch means is mounted on said downwardly inclined surface.

6. The apparatus of claim 5, wherein said latch means includes a longitudinally disposed latch frame member having an upwardly opening cavity formed therein.

7. The apparatus of claim 6, wherein said latch means further comprises a bell crank means pivotally secured thereto.

8. The apparatus of claim 7, further comprising a second bias means that bears against said bell crank means and maintains said bell crank means in an equilibrium condition.

9. The apparatus of claim 8, wherein a first arm of said bell crank extends into said upwardly opening cavity when said bell crank is in its equilibrium position.

10. The apparatus of claim 9, further comprising a foot pedal means secured to a forward end of said bell crank means so that downwardly directed pressure imparted against said foot pedal means compresses said second bias means and effects rotation of said bell crank means about its pivot so that said first arm thereof withdraws from said upwardly opening cavity.

11. The apparatus of claim 10, wherein said connector means is a cradle base member disposed transversly to the longitudinal axis of said elongated arm member and positioned in alignment with said upwardly open cavity so that a first end of said cradle base member extends into said cavity when said elongate arm member is pivoted downwardly against the tension of said first bias means.

12. The apparatus of claim 11, wherein said cradle base member transiently displaces said first arm of said bell crank means out of said upwardly opening cavity as said cradle base member enters said cavity and wherein said first arm captures said cradle base member and retains it in said cavity after said cradle base member has entered said cavity.

13. An apparatus that delivers a football into the hands of an athlete, comprising:

a base means that supports said apparatus;

an upstanding post member supported by said base means;

an elongate arm member pivotally mounted to said post member for pivoting in a substantially vertical plane;

a first bias means having a first end secured to an upper part of said post member and a second end secured to said elongate arm member about half way between a distal end of said arm member and said pivotal mount to said post member;

a football cradling means attached to said distal end of said arm member;

said cradling means having an elongated cradle base member disposed transverse to the longitudinal axis of said elongate arm member;

a latch means mounted on said apparatus support base means;

said latch means included a latch frame member having an upwardly opening cavity formed therein;

said latch further comprising a bell crank pivotally secured to said latch frame member;

a second bias means that urges a first arm of said bell crank into said cavity;

said cradle base member being captured by said first arm of said bell crank when said elongate arm member is pivoted downwardly said support base and against the bias of said first spring; and said cradling means moving briskly upwards by said first means when said bell crank is pivoted against said second bias means to release said cradle bias member.

14. The apparatus of claim wherein said cradling means includes a pair of "U"-shaped ball retainer members secured, in laterally spaced relation on said cradle base member.

15. The apparatus of claim 14, wherein each of said retainer members is longitudinally aligned on said base member and having a pair of upwardly projecting retainer arm members.

16. The apparatus of claim 15, wherein said retainer arm members of each pair of retainer members extend in diverging relation with respect to one another such that their respective uppermost free ends are spaced further apart than their respective lowermost ends.

17. The apparatus of claim 16, wherein said retainer arm members of each pair of retainer members extend in diverging relation with respect to the opposite pair of retainer members such that the uppermost free ends of all of said retainer arm members are spaced further apart than their respective lowermost ends.

18. An apparatus that cradles a football and carries the football from a first position near the ground to a second position thereabove, comprising:

an elongated football cradle member;

an elongate, pivotally mounted arm member having said football cradle member attached at one of its ends, said cradling member being attached transverse to the longitudinal axis of said arm member;

an upstanding hollow post member to which said arm member is pivotally mounted;

a turnbuckle member disposed in the hollow interior of said post member;

an eyebolt member secured to said turnbuckle member;

the eye of said eyebolt member being disposed exteriorly of said post member, on a forward side thereof;

an elongate bias means having its opposite ends secured intermediate the ends of said arm member and having its medial part extending through the eye of said eyebolt member;

a base member supporting said post member;

a latch means secured to said base member, said latch means being positioned to engage said cradle member;

said latch means having a pivotally mounted arm, said arm having means to engage and hold said cradle member against the bias of said bias means until said latch means is pivoted out of engagement with said cradle member; and a foot pedal means secured to said latch means;

whereby said latch means releases said cradle member when pressure is applied to said foot pedal means to effect rotation of said latch means until it releases said cradle member.

19. The apparatus of claim 18, wherein said latch means includes a latch frame member having an upwardly opening cavity that receives a preselected part of said cradle member, and wherein said latch means is a bell crank member pivotally secured to said latch frame member, said bell crank has a portion for engaging and holding said preselected part of said cradle member.

* * * * *